US005687703A

United States Patent [19]

Vyprachticky

[11] Patent Number: 5,687,703

[45] Date of Patent: Nov. 18, 1997

[54] COMPOUND ARCHERY BOW WITH BILATERAL CABLE CAMS

[76] Inventor: Emil Vyprachticky, 7713 Webster Way, Arvada, Colo. 80003

[21] Appl. No.: 630,902

[22] Filed: Apr. 4, 1996

[51] Int. Cl.[6] ..... F41B 5/10

[52] U.S. Cl. ..... 124/25.6; 124/900

[58] Field of Search ..... 124/25.6, 900

[56] References Cited

U.S. PATENT DOCUMENTS

| | | | |
|---|---|---|---|
| 4,300,521 | 11/1981 | Schmitt | 124/25.6 |
| 4,440,142 | 4/1984 | Simonds | 124/25.6 |
| 4,669,445 | 6/1987 | Schaar | 124/25.6 |
| 4,993,399 | 2/1991 | Chattin | 124/25.6 |

*Primary Examiner*—John A. Ricci
*Attorney, Agent, or Firm*—Richard W. Hanes

[57] ABSTRACT

In a compound archery bow which includes a handle and two attached flexible limbs, having first and second lateral sides, the improvement including, first and second rotatable bow string cams, each having a grooved peripheral rim and mounted on a first lateral side of each of the limbs and first and second rotatable power cable cams, each having a grooved peripheral rim and mounted on the second lateral side of each of the limbs for respective rotation with the first and second bow string cams, a bow string carried in the grooved peripheral rims of the bow string cams, where the two terminal ends of the bow string are anchored to the respective first and second bow string cams, a first power cable, having one end thereof anchored to the first power cable cam, trained in the grooved peripheral rim of the first power cable cam and run to the distal end of the opposing limb where the other end of the said power cable is secured, and a second power cable, having one end thereof anchored to the second power cable cam, trained in the grooved peripheral rim of the second power cable cam and run to the opposing limb where the other end of the said power cable is secured.

5 Claims, 3 Drawing Sheets

COMPOUND ARCHERY BOW WITH BILATERAL CABLE CAMS

The present invention relates to archery and more specifically to the construction of a compound archery bow.

BACKGROUND

Compound archery bows have been used and sold since at least 1969 when H. W. Allen patented an Archery Bow With Draw Force Multiplying Attachments, U.S. Pat. No. 3,486,495. Typically, a present day compound bow comprises a central handle riser mounting a pair of opposed elongated flexible limbs. Many of the current bow limbs have a bifurcated tip forming a pair of tip sections between which is mounted an eccentric pulley or roller assembly which carries the bowstring and the stretches of cable which provide the mechanical advantage for the compound bow. The mounting and location of the pulleys, wheels and cams creates several problems and presents disadvantages which detract from the otherwise advantageous features of a compound bow.

First, the forces absorbed by the bow limbs during a draw of the bowstring become asymmetrical relative to the longitudinal axis of the bow creating a twisting of the limbs and an introduction of error to the flight of the arrow. This problem has been addressed by designing into the limbs an asymmetrical cross section to provide a restoring force to counteract the unbalanced forces created during the draw, as shown in one example in the U.S. Pat. No. 4,669,445, to John Schaar, issued Jun. 2, 1987.

A second and almost universally accepted problem is that of interference between the stretch of the compound bow cables and the arrow and its fletchings. The concern is recognized and discussed in the early U.S. Pat. No. 4,079,723 to Rex F. Darlington, issued Mar. 21, 1978. In that patent specification it is stated that with a standard bow, the centerline of the handle is in line with the bowstring and centered relative to the flexing limbs of the bow. However, when a compound bow is used, there are additional cords or cables in the bow arch which must be cleared by the arrow. Darlington goes on to say that this usually results in the nocking stretch being placed to one side of the bow and the arrow is then being shot across the bow at an angle to a center plane through the limbs. Evidence of an earlier effort to avoid the cable interference is seen in U.S. Pat. No. 4,683,865 to Vincent F. Troncoso, issued Aug. 4, 1987. There the cables were diverted laterally away from the bowstring and arrow by engagement with the grooves of a wheel mounted on the bow below the handle.

The currently used method in compound bows to prevent interference between the cables and an arrow is to provide a cable guard, comprising a shaft or bar projecting rearwardly from the bow handle to contact and confine the center stretch portion of the cables to a position laterally of their normal run to keep them away from the arrow. The difficulty with this very accepted arrangement is two-fold. First, the protruding shaft of the cable guard clutters the assembly and provides yet another "attachment" to an already complex piece of equipment. Secondly, and more importantly, the means of holding the cables to one side produces undesired forces on the cables. Typically the cable guard comprises a slide member positioned on the cylindrical shaft of the guard bar where the slide is provided with bores through which the cables pass. The friction between the cables and the guard slide and the friction of the slide on the guard shaft during use of the bow contribute substantial drag forces which increase the required energy loading of the limbs and decrease the effective energy release, resulting in diminished force delivered by the bow to the arrow.

Bifurcation of the bows limbs results in a further problem. In many instances, depending on the design and material of the limbs, the tip of the bow limbs must be reinforced around the crotch of the notch in order to avoid fracture of the narrow limb tip sections.

In some bow construction, bifurcation of the tips of the limbs is avoided by mounting the pulleys on brackets which are fastened to the tips of the limbs, as shown in U.S. Pat. No. 4,457,287 to Babington, issued Jul. 3, 1984, U.S. Pat. No. 4,079,723 to Darlington, issued Mar. 21, 1978 and U.S. Pat. No. 4,457,288 to Ricord, issued Jul. 3, 1984. While perhaps eliminating the problem of structural weakness in the bifurcated limb tips, brackets present their own structural and mounting problems and do not eliminate the necessity of a cable guard.

OBJECTS OF THE INVENTION

In view of the many disadvantages attendant with the conventional mounting the pulleys of a compound bow, especially in relation to the pulley's alignment with the longitudinal axis of the limbs, it is the primary object of the present invention to provide a mounting scheme for the cable pulleys of a compound bow which will eliminate the problems of the prior art bows described above.

More specifically, it is an object of the invention to provide a compound bow whose construction will eliminate twisting forces in the limbs, sometimes referred to as limb/pulley torque, without having to shape the limbs to resist such forces.

Another object of the invention is to provide a compound bow whose construction does not limit the size of the cable pulleys, or eccentric cams, making it readily adaptable to the interchangeable use of larger pulleys, or cams, in order to selectively increase the distance of the bow string draw.

A further object of the invention is to provide a compound bow whose design and construction separates the bow string from the power assist cables and thus eliminates the need for a cable guard while still providing adequate clearance for the arrow fletchings.

Another object is to provide a compound bow having the combined properties of a shorter overall bow length with the same power and string draw of a longer bow.

Another object is to provide eccentric cams for a compound bow which have adjustable cable anchoring means for selectively changing the tension in the bow string and power cables and which have safety rims for damage protection.

A still further object is to provide a compound bow where the eccentric cams are mounted on the limbs in such a fashion as to permit extension of the ends of the limbs beyond the radius of the cams in order to provide additional shielding and damage protection to the eccentric cams and the cables and bow string which are disposed in the circumferential rim grooves of the cams.

An object of the invention is to provide means for mounting the eccentric cams of a compound bow on both lateral sides of the bow limbs which will provide a symmetry of forces that will allow the use of a more symmetrical handle riser and a shallower arrow window, with correspondingly increased handle stability and strength.

Other and still further objects, features and advantages of the present invention will become apparent upon a reading the following detailed description of the invention, taken in conjunction with the following described drawings.

SUMMARY OF THE INVENTION

The improved bow of the present invention achieves the objects thereof by individualizing the bow string and the conventional compound cables and mounting the respective cams for those two bow elements bilaterally of the limbs. With such a mounting of the cams, the bowstring is substantially aligned with one lateral side of the bow, while the cables are substantially aligned with the other lateral side of the bow, creating a natural separation between the bowstring and the cables.

The most pertinent prior art appears to be U.S. Pat. No. 4,669,445 to John Schaar, issued Jun. 2, 1987. In FIGS. 8–11 of that patent there is disclosed an archery bow limb in which a cable tie-off roller is positioned on one side of the limb and a pair of working pulleys for a single cable/bowstring are positioned on the opposite side of the limb. This system is said to provide adequate clearance between the bow string and the other cable segments. However, this arrangement still requires a trapezoidal cross sectional shaped limb in order to avoid the effects of limb/pulley torque because the forces on the limb are made asymmetrical with this mounting arrangement.

In the present invention the bowstring is located on the side of the bow where the arrow is positioned while the cables are disposed on the other side of the bow, thus eliminating the need for a cable guard and a trapezoidal cross section of the bow limbs.

DETAILED DESCRIPTION

Figure 2:
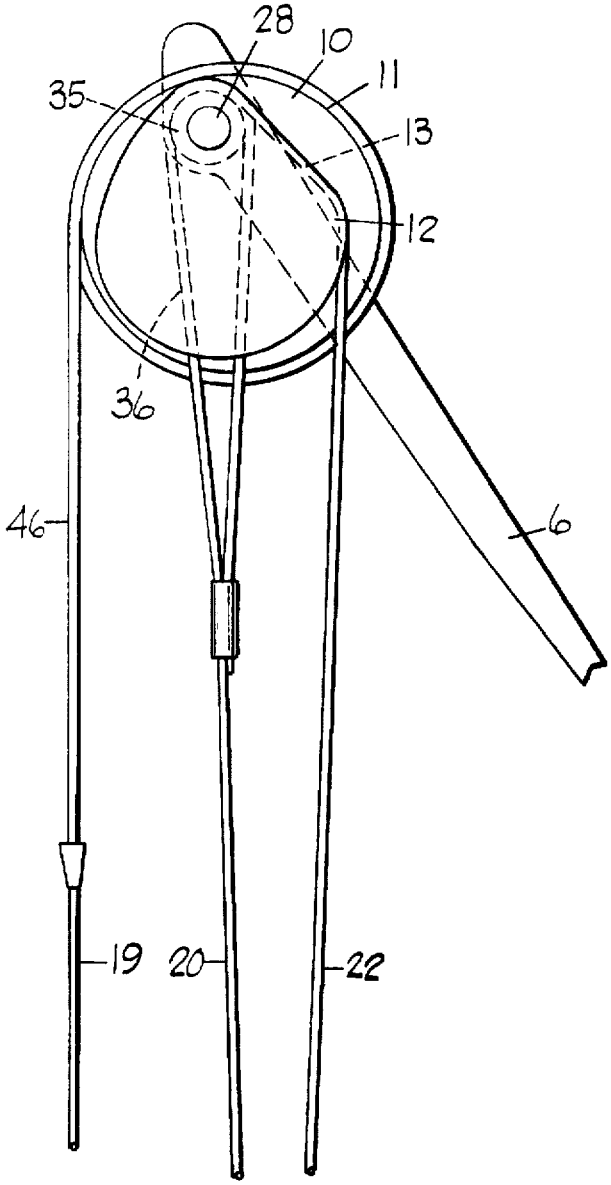
FIG. 2 is an enlarged fragmentary right side view of the outer or distal end of one of the limbs of the bow of FIG. 1.
Figure 1:
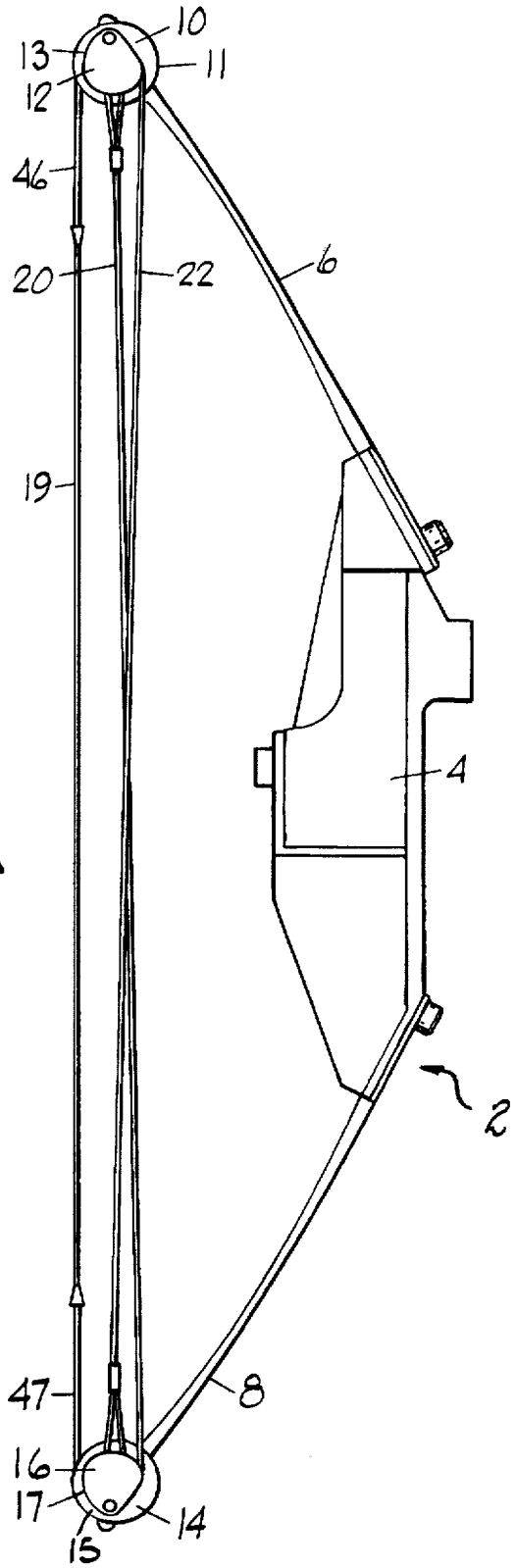
FIG. 1 is a right side view of the compound bow of the present invention showing the cable pulleys in the form of non-circular eccentrically mounted cams.
Figure 4:
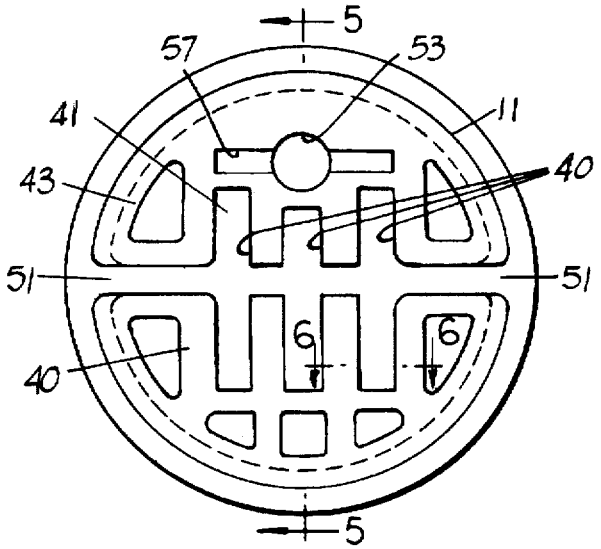
FIG. 4 is an enlarged side view of the interior facing side of the bow string cable pulley. The cams in this view and the view of the subsequent FIG. 5 are shown with a circular shape which may be used as an alternative to the cam shape shown in FIG. 1.
Figure 3:
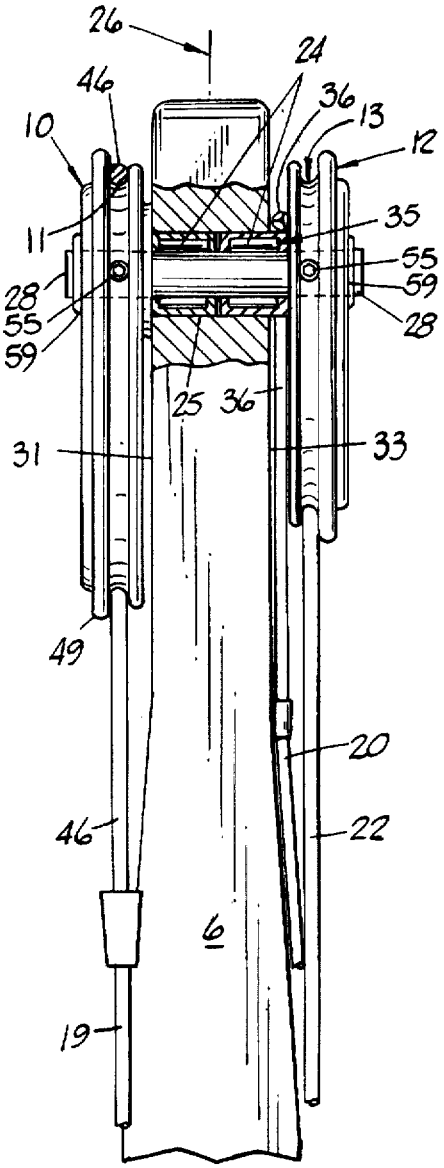
FIG. 3 is an enlarged fragmentary rear view of the outer or distal end of one of the limbs of the bow of FIG. 1, with a portion thereof shown cut away and in cross section.
Figure 7:
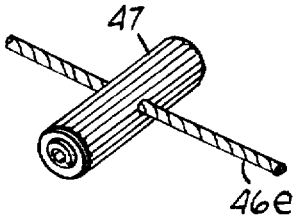
FIG. 7 is a fragmentary perspective view of the anchoring end of a typical one of the cables.
Figure 8:
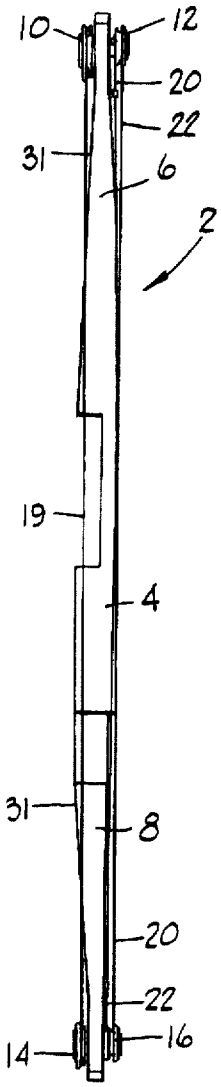
FIG. 8 is a rear view of the compound bow of the present invention.
Figure 9:
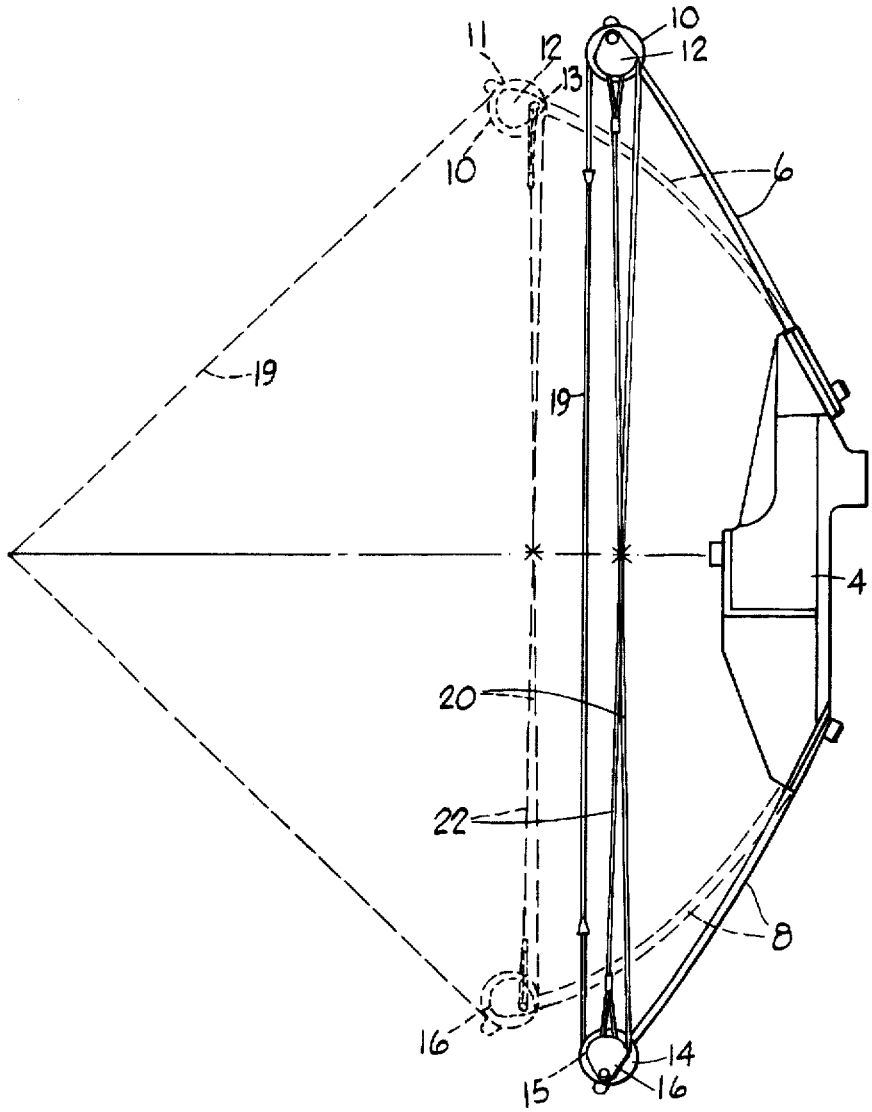
FIG. 9 is a left side view of the bow of the present invention shown without any draw of the bow string and also shown in a combination of phantom and solid lines to illustrate the relative position of certain components of the bow when the bow string is drawn.

The compound bow 2 of the present invention is shown in FIGS. 1, 8 and 9. The bow comprises a handle riser 4 with first and second (or upper and lower) elongate and flexible limbs 6 and 8 attached thereto. An enlarged left side view of the distal portion of the limb 6 is shown in FIG. 2 and an enlarged front view of the same thing is shown in FIG. 3. A pair of cams 10 and 12 are rotatably mounted bilaterally of the limb 6 near or at the distal end of the limb, as best seen in FIGS. 1 and 3. Cams 14 and 16 are similarly rotatably mounted bilaterally of the limb 8 near or at its distal end, as seen in FIGS. 1 and 9. While the elements 10, 12, 14 and 16 may be referred to as cams or eccentric cams, they can be conceived as eccentrically mounted circular wheels or circular discs, depending on the design choice of the let-off force curve. If wheels or circular discs are chosen they are preferably eccentrically mounted to rotate about a point displaced from the center of the wheel. The literature often refers to these rotating elements as cams or pulleys and in order to avoid any confusion attention will be given to the definition and use of the various terms. "Cam" is defined as an eccentric projection on a revolving shaft, shaped so as to give some desired linear motion to a follower. See Chambers's Technical Dictionary, published by the MacMillan Company, New York 1961. Therefore, in order to generically describe the eccentrically mounted devices, shown in FIGS. 1, 2 and 9 and referred to by numerals 10, 12, 14 and 16, but also to include in that description an eccentrically mounted circular wheel, such as shown in FIGS. 3 and 4, the rotatable devices 10, 12, 14 and 16 may alternatively be referred to in this specification as cams, wheels, pulleys or, more generically, as "eccentric projections".

Before describing the features of the improved bow of the present invention in detail, the overall construction and combination of parts will be described. Each of the cams 10, and 14 have grooved circumferential rims 11 and 15 for the purpose of carrying a short length of the respective ones of the bow string cables 46 and 47 which are attached to the respective ends of the bow string 19, as seen in FIGS. 1 and 3. The free end of the bow string cables 46 and 47 are adjustably anchored to the interior of the cam on which the cable's end is carried, as will be more fully described later. As best seen in FIGS. 3 and 8, the bow string stretches across the bow 2 in substantial planer alignment with the lateral side 31 of the limbs 6 and 8, that is the side of the bow on which the arrow is positioned. A note should be made at this point about terminology. As described above, the preferred form of the invention comprises a bow string 19 and two bow string end terminating cables 46 and 47. The cables 46 and 47 are better suited to ride in the channels of the cams 10 and 14 and be anchored within those cams than would a conventional stranded bowstring. Furthermore, the use of separate end terminating cables, such as those shown by reference numerals 46 and 47 enables the bow string to be replaced without having to restring the cams and the anchors within the cams. While terminating cables are preferred, the bowstring itself could wrap onto the cams 10 and 14 and be anchored within these cams, just as is described in this specification in regard to the bow string cables 46 and 47. Accordingly, in the claims, reference to the bowstring will include both the bowstring as an entire entity, cooperating directly with the bowstring cams, as well as a bow string with attached terminating end cables, such as the cables 46 and 47 which run onto the peripheral grooves of the bowstring cams and are anchored into the cams.

The matter of terminology is also relevant to the compound cables 20 and 22. At least some of the compound bow literature describes the power elements of such a bow as including limbs, pulleys, bowstring and cables, the bowstring and cables often being a single string with various stretches or runs. The two compound or power cables 20 and 22 of the bow of the present invention are, however, separate and distinct from the bow string 19 and the bow string cables 46 and 47. The two power cables 20 and 22 are also separate and distinct from one another. Therefore, in order to avoid confusion, the cables 20 and 22 will be referred to in this specification as the power cables or power assist cables to not only identify them but to suggest their function.

The power cable cams 12 and 16 contain circumferentially grooved rims 13 and 17 respectively for carrying the short length of the power assist cables 20 and 22 which pass over and around them. The first power cable 20 is anchored, by a tie-off loop 36 at one of its ends, to the distal end of the upper limb 6. The cable 20 then traverses the stretch across the length of the bow 2 and wraps into the circumferentially grooved rim 15 of the cable cam 16 where its other end is adjustably anchored to the cam's interior. The power cable 22, on the other hand, is anchored at one of its ends, by a tie-off end loop 36, to the distal end of the lower limb 8. The cable 22 then traverses the stretch across the length of the bow 2 and wraps into the circumferentially grooved rim 13 of the power cable cam 12 and is then adjustably anchored to the interior of that cam. The power assist cables 20 and 22 are laterally offset, one from the other, a distance equal to approximately one half the lateral thickness of the cable cams 12 and 16. Together, the cables 20 and 22 lie in a plane which is in alignment with at least a portion of the lateral edge 33 of the limbs 6 and 8, depending on the designed shape of the limbs and their side curvature, as seen in FIGS. 3 and 8. It is immediately apparent that the substantial lateral distance between the stretch of the bow string 19 and the natural stretch of the power cables 20 and 22 avoids any interference between the arrow and the power cables, thus eliminating the need for any means to laterally restrain the cables, such as a cable guard. At the position of the nocking point on the bow string 19, the power assist cables are, in their position of normal stretch, laterally offset from the arrow and the bow string, without the mechanical intervention of a prior art cable guard.

The bow string cams 10 and 14, which carry the bow string cables 46 and 47, are preferably provided with a greater diameter or eccentric force moment than the power assist cable cams 12 and 16 in order to provide the mechanical advantage of multiplying the force exerted by the archer during the draw of the bowstring. The matter of diameter, or effective operating size, of the bow string cams 10 and 14 brings up another object of the invention. Because the diametric size of the cams is not limited by the dimensions of a mounting notch or a mounting bracket, eccentric projections of any diametrical size can be used. Thus, the same bow can easily be fitted with a large diameter bowstring cam for the long draw, preferred perhaps by tall archers, or alternatively, fitted with a smaller diameter cam which supports a shorter draw for shorter stature or youthful archers.

Since the objects of the invention are achieved by the bilateral mounting of the eccentric projections near or at the distal ends of the bow limbs 6 and 8, the details of a preferred form of that mounting will now be described. What is said with respect to the limb 6 and the cams mounted thereon, applies equally to the limb 8 and the cams mounted on that limb.

As seen in FIG. 3, at or near the distal end of the limb 6 a pair of longitudinally juxtaposed needle bearings 24 are disposed within a transverse bore 25 through the body of the limb 6, perpendicular to its longitudinal axis 26. An axle 28, whose ends extend beyond the lateral sides 31 and 33 of limb 6 is carried by and rotates within the bearings 24. The cam 10 is securely attached to the end of the axle 28 which extends laterally beyond the side 31 of the limb 6. The cable cam 12 is securely attached to the other end of the axle 28 which extends beyond the lateral side 33 of the limb 6. Because both of the cams 10 and 12 are fixed to the axle 28, rotation of the bow string cam 10, by drawing the bow string 19, will cause the cam 12 to rotate, taking up a portion of the cable 22 which is carried in the cam's circumferential groove 13. Obviously, drawing the bow string will have a similar effect on the cams mounted on the limb 8, resulting in a shortening of the stretch of both of the power cables 20 and 22. This shortening of the stretch distance of the cables assists in creating bending of the limbs with a resultant increase in energy loading over what would have resulted from equivalent force exerted in drawing a bowstring acting alone and without the benefit of the power cables.

Further examining FIG. 3, it is seen that the power cable cam 12 is separated from the lateral edge 33 of the limb 6 by the protruding end of one of the bearings 24. This exposed end of the bearing 24 acts as a mooring post 35 for securing fast the loop 36 formed in the tie-off end of the power assist cable 20. The mooring post need not necessarily be an extension of the axle bearing. It can be constructed a number of different ways. For example, a boss on the lateral side 33 of the limb could also be used as the mooring post for the tie off end 36 of the cable 20.

As earlier referred to, both the bow string cables and the power assist cables are trained around at least a portion of the rim grooves of the cams, following which the cables are directed to the interior of the cams where they are anchored. FIGS. 3–6 illustrate the details of the construction of a typical one of the four eccentric projections used in the bow assembly, showing the so-called cam as a circularly shaped eccentrically mounted wheel or pulley, being an alternative form to that of the cams shown in FIGS. 1 and 2. In the prior art compound bows, the wheels or pulleys are constructed of metal in order to obtain the thinnest thickness profile, while, at the same time, achieving the necessary strength. Because the cams of the bow of the present invention are not mounted within the confines of a notch in a bifurcated bow limb or between the sides of a mounting bracket, thickness of the cam is not a defining criteria for the choice of materials employed in the construction of the cams. Accordingly, the cams may be economically molded from a plastic material, instead of being molded or machined from metal, a more expensive alternative.

Figure 5:
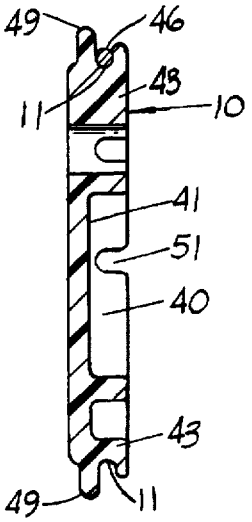
FIG. 5 is a cross sectional view of the bow string cable pulley taken along lines 5—5 of FIG. 4.
Figure 6:
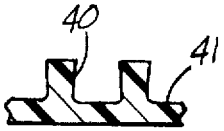
FIG. 6 is a partial cross sectional view of the bow string cable pulley, taken along lines 6—6 of FIG. 4.

For purpose of a general explanation of the construction of all of the cams, the bow string cable cam 10 will be described, with particular reference to FIGS. 4–7. FIG. 4 shows the inside side view of a molded plastic cam, that is, the side of the cam which faces the lateral side surface 31 of the limb 6. A rim forming flange 43 rises perpendicularly from the cam's floor 41 to provide the base of the groove 11 in which the cable 46 of the bow string 19 runs. As seen in FIG. 5, the flange 43 is shaped to define the basic groove 11, with the outside side wall 49 of the groove 11 being raised well beyond the outer extent of the cable 46 as it lies in the groove. The purpose of this raised edge is to protect the groove 11 of the cam, and the cable therein, from damage when the end of the bow is supported on the ground or strikes an object which could dent the rim of the cam, causing damage which could possibly allow the cable 46 to come out of the groove during a draw, when tension in the cable is high, or during a release.

A channel 51 traverses the diameter of the cam's interior, interrupting the continuity of the groove on diametrically opposed sides of the cam 10. The channel provides cable access from the groove 11 to a plurality of undercut cable anchoring flutes 40, disposed perpendicularly to and across the slot 51 in the interior of the cam. In use, after the cable 46, disposed in the groove 11, wraps partially around the cam 10, the end **46*e* of the cable 46 is trained through one of the interruptions in the groove 11 and into the diametrical slot 51. A cylindrical locking bar 47, having a diameter very similar to that of the flutes 40, is secured perpendicularly to the end 46*e* of the cable. The locking bar 47 is pressed down into a selected one of the flutes 40, thus securely anchoring the end of the cable 46*e* to the cam 10. The plurality of flutes 40 provide a choice of several positions in which to place the locking bar 47, thus creating a means for easily adjusting the effective length of the bowstring 19. The adjustment is preferably made the same on both of the cams 10 and 14. Similar adjustments to the working length of the power assist cables 20 and 22 are available through the use of the same kind of anchoring and cable length adjustment flutes in the cams 12 and 16 as those which have just been described for the bow string cams 10 and 14**.

The cam 10 is also provided with an off-center aperture 53 which receives the mounting axle 28. A number of well known options are available for interconnecting the axle and the cam 10, however a preferred method, in order to achieve easy replacement or substitution of the cam, is to provide a rollpin 55 which passes diametrically through the axle and, in mounted position, fits within the rollpin retaining slot 57 which is longitudinally aligned with a diameter of the aperture 53, extending outwardly from the periphery of the aperture on both sides thereof. Snap rings 59 maintain the cam axially on its mounting axle in a manner well known to the art.

Although only cam 10 has been described in detail, the same explanation and description applies to each of the other cams 12, 14 and 16, with respect to the cables which are carried by those particular cams.

I claim:

1. A compound archery bow comprising, a handle riser, first and second elongate limbs attached to the handle riser, cylindrical bearing means laterally disposed within each of the limbs distally of the handle riser and protruding outwardly of the lateral edge of the respective riser on at least one lateral side thereof, first and second axle means, each rotatably carried by the respective bearing means and extending outwardly from the lateral sides of the risers, first and second cam means eccentrically mounted on the outwardly extending ends of each of the axle means, for rotation therewith, wherein the peripheral edges of the cam means comprise cable carrying grooves, a bow string carried in the grooves of each of the first cam means and having terminal ends which are attached to the respective first cam means, a first cable, having a tie-off end anchored to the laterally outwardly extending bearing means carried by the first limb, and extending to the distal end of the second limb where it is trained over the groove of one of the second cam means and whose other terminal end is secured to the said one of the second cam means, and a second cable, having a tie-off end anchored to the laterally outwardly extending bearing means carried by the second limb, and extending to the distal end of the first limb where it is trained over the groove of the other one of the second cam means and whose other terminal end is secured to the said other one of the second cam means.

2. In a compound archery bow which includes a handle riser and first and second longitudinally extending limbs attached thereto, the improvement comprising, a pair of similarly dimensioned first eccentric projection means, each having a grooved circumferential rim for carrying a cable, and respectively mounted for rotation on a first lateral side of each of the two limbs, distally of the riser, a pair of similarly dimensioned second eccentric projection means, each having a grooved circumferential rim for carrying a cable, and respectively mounted for rotation on a second lateral side of each of the two limbs, distally of the riser, means interconnecting the first and second eccentric projection means on the respective limbs for common rotation of said first and second eccentric projection means, a bow string disposed in the grooved circumferential rim of the first eccentric projection means whose ends are secured to the respective ones of the first eccentric projection means, a first cable having a tie-off end and a free end, where the tie-off end is secured to the said second lateral side of the first limb, distally of the riser, and where the first cable is disposed in the grooved circumferential rim of the second eccentric projection means which is mounted on the second limb and whose free end is secured to the same eccentric projection means in whose grooved rim it is disposed, a second cable having a tie-off end and a free end, where the tie-off end is secured to the said second lateral side of the second limb, distally of the riser, and where the second cable is disposed in the grooved circumferential rim of the second eccentric projection means which is mounted on the first limb and whose free end is secured to the same eccentric projection means in whose grooved rim it is disposed.

3. The bow of claim 2 where the dimension of the circumferential rim of the second eccentric projection means is less than that of the first eccentric projection means.

4. In a compound archery bow having two limbs attached to a bow handle and where the limbs each have first and second lateral sides, the improvement comprising, first and second bow string cams, each having cable carrying peripheral rims and rotatably mounted on the first lateral side of the respective two limbs, first and second power cable cams, each having cable carrying peripheral rims and mounted on the second lateral side of the respective two limbs, each to be rotatable with the bow string cam which is mounted on the same limb, first and second cable anchor means disposed on the second lateral side of each of the respective limbs, a bow string carried in the rims of the bow string cams, where the terminal ends of the bow string are attached to the respective first and second bow string cams, a first power cable having one end attached to the first cable anchor means and run to the distal end of the opposing limb, where the other end thereof is carried by the rim of the second power cable cam and is then attached to the second power cable cam, and a second power cable having one end attached to the second cable anchor means and run to the distal end of the opposing limb, where the other end thereof is carried by the rim of the first power cable cam and is then attached to the first power cable cam.

5. A compound archery bow comprising, a pair of flexible limbs interconnected by a handle portion, first and second rotatable input drive means carried by and disposed on a first lateral side of each of the respective limbs, a bow string attached at each of its two ends to the respective first and second input drive means for rotating the input drive means when the bow string is drawn, first and second output drive means, carried by and disposed on a second and opposing lateral side of each of the respective limbs, and operatively connected to the respective input drive means, cable means interconnecting each of the output drive means and the opposing limb, for drawing the distal ends of the limbs toward one another when the bow string is drawn.

* * * * *